US009245515B2

(12) United States Patent
Llewellyn

(10) Patent No.: US 9,245,515 B2
(45) Date of Patent: Jan. 26, 2016

(54) EARPHONE

(71) Applicant: Cirrus Logic International (UK) Ltd., Edinburgh (GB)

(72) Inventor: Steven Llewellyn, Thatcham (GB)

(73) Assignee: Cirrus Logic International Semiconductor Ltd., Edinburgh (GB)

( * ) Notice: Subject to any disclaimer, the term of this patent is extended or adjusted under 35 U.S.C. 154(b) by 192 days.

(21) Appl. No.: 14/024,436

(22) Filed: Sep. 11, 2013

(65) Prior Publication Data

US 2014/0153733 A1 Jun. 5, 2014

Related U.S. Application Data

(60) Provisional application No. 61/701,043, filed on Sep. 14, 2012.

(30) Foreign Application Priority Data

Sep. 14, 2012 (GB) ..... 1216453.9
Apr. 9, 2013 (GB) ..... 1306448.0

(51) Int. Cl.

| | |
|---|---|
| ***H04R 25/00*** | (2006.01) |
| ***G10K 11/16*** | (2006.01) |
| ***H04R 1/10*** | (2006.01) |
| ***G10K 11/178*** | (2006.01) |

(52) U.S. Cl.

CPC ..... *G10K 11/16* (2013.01); *G10K 11/1788* (2013.01); *H04R 1/10* (2013.01); *H04R 1/1033* (2013.01); *G10K 2210/1081* (2013.01); *G10K 2210/3045* (2013.01); *G10K 2210/3214* (2013.01); *H04R 1/1083* (2013.01)

(58) Field of Classification Search

CPC ..... H04R 1/1033
USPC ..... 381/325, 337, 338, 348, 349, 370, 380, 381/382, 373; 181/135

See application file for complete search history.

(56) References Cited

U.S. PATENT DOCUMENTS

| | | | | |
|---|---|---|---|---|
| 4,972,488 | A * | 11/1990 | Weiss et al. | 381/325 |
| 2004/0084245 | A1* | 5/2004 | MacKin et al. | 181/156 |
| 2011/0081034 | A1* | 4/2011 | Tung et al. | 381/332 |
| 2011/0249849 | A1* | 10/2011 | Guth et al. | 381/328 |
| 2012/0076340 | A1 | 3/2012 | Uchida et al. | |
| 2012/0155691 | A1 | 6/2012 | Chen | |
| 2013/0083956 | A1* | 4/2013 | Hayashida | 381/380 |
| 2013/0343593 | A1* | 12/2013 | Howes et al. | 381/380 |

FOREIGN PATENT DOCUMENTS

| | | | |
|---|---|---|---|
| EP | 0 611 111 | A1 | 8/1994 |
| JP | 2012-124587 | A | 6/2012 |

* cited by examiner

*Primary Examiner* — Joseph Saunders, Jr.
(74) *Attorney, Agent, or Firm* — Jackson Walker L.L.P.

(57) ABSTRACT

An earphone has a housing, with a speaker mounted within the housing. A cable inlet contains a cable that includes a wire connected to the speaker. The cable and the cable inlet have different cross-sectional shapes, such that the cable is in contact with the inner surface of the cable inlet over a substantial portion of their length, while a rear volume of the speaker is vented through the cable inlet. This ensures that the cross-sectional area through which the rear volume is vented through the cable inlet remains relatively constant. The earphone may further comprise a microphone, positioned to detect ambient noise approaching the ear of a wearer of the earphone, and the cable may then further include a wire connected to the microphone.

27 Claims, 7 Drawing Sheets

EARPHONE

This application claims the benefit of U.S. Provisional Application No. 61/701,043, filed on Sep. 14, 2012, the disclosure of which is herein incorporated by reference.

BACKGROUND OF THE INVENTION

1. Field of the Invention

This invention relates to an earphone, and in particular to an earphone of the intra-concha type.

2. Description of the Related Art

Intra-concha earphones are small earphones that are placed, in use, in the user's outer ear, adjacent to the entry to the user's ear canal.

It is known that, in order that the earphone should produce sound with a good low frequency response, the earphone casing should be provided with a port for venting pressure generated by the speaker. It is also known that this port may be provided in the inlet through which the cable enters the earphone casing.

However, it is often advantageous for this port to have a known cross-sectional area, and this cannot usually be achieved when the port is provided in the inlet through which the cable enters the earphone casing, because the movement of the cable can alter the effective cross-sectional area.

Noise cancelling systems are well known, in which a microphone is also included in the earphone casing, for detecting ambient noise. One type of noise cancelling system has an adaptive gain in the noise cancelling circuitry. That is, the earphone is provided with an error microphone, positioned so as to detect the level of ambient noise reaching the wearer's ear canal. The gain applied to the noise cancelling signal is then controlled, based on that level of ambient noise. One issue that arises with such earphones in particular is that, when the gain is set to a high level, and the venting port becomes coupled to the microphone for detecting ambient noise (for example by the wearer's finger approaching the earphone), this will be interpreted as a very high level of ambient noise, and the noise cancelling system will generate a very loud sound in an attempt to overcome that ambient noise.

It is therefore advantageous for the venting port to be located well away from the microphone for detecting ambient noise.

SUMMARY OF THE INVENTION

According to a first aspect of the present invention, there is provided an earphone, comprising:

an earphone housing; and a speaker mounted within the earphone housing, wherein the earphone comprises a cable inlet, containing a cable that includes a wire connected to the speaker, and wherein the cable and the cable inlet have different cross-sectional shapes, such that the cable is in contact with the inner surface of the cable inlet at at least two points on their cross-section over a substantial portion of their length, while a rear volume of the speaker is vented through the cable inlet.

The earphone may further comprise:

a first microphone, positioned to detect ambient noise approaching the ear of a wearer of the earphone, wherein the cable further includes a wire connected to the first microphone.

According to a second aspect of the present invention, there is provided a noise cancelling system, comprising:

noise cancellation circuitry; and an earphone according to the first aspect with the first microphone, wherein the noise cancellation circuitry is adapted to receive an ambient noise signal from the first microphone, and to generate a noise cancellation signal in response thereto.

According to a third aspect of the present invention, there is provided an earphone, comprising:

an earphone housing; and a speaker mounted within the earphone housing, wherein the earphone comprises a cable inlet, containing a cable that includes a wire connected to the speaker, and wherein the cable inlet has projections on an inner surface thereof, such that the cable is in partial contact with said projections on the inner surface of the cable inlet over a substantial portion of the length of the cable inlet, while a rear volume of the speaker is vented through the cable inlet.

According to a fourth aspect of the present invention, there is provided a noise cancelling system, comprising:

noise cancellation circuitry; and an earphone according to the third aspect with a first microphone, wherein the noise cancellation circuitry is adapted to receive an ambient noise signal from the first microphone, and to generate a noise cancellation signal in response thereto.

BRIEF DESCRIPTION OF THE DRAWINGS

For a better understanding of the present invention, and to show how it may be put into effect, reference will now be made, by way of example, to the accompanying drawings, in which.

DETAILED DESCRIPTION OF THE PREFERRED EMBODIMENTS

Figure 1:
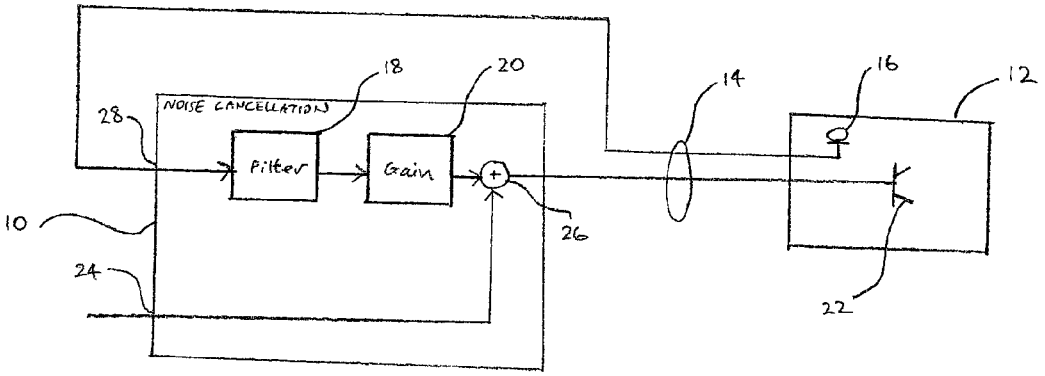
FIG. 1 illustrates a noise cancellation system.

FIG. 1 shows the form of a noise cancelling system, including noise cancellation circuitry 10, for use with an earphone 12. The noise cancellation circuitry 10 can for example be provided in a sound reproducing device, such as a communications device, for example a mobile phone; a portable music player, for example an MP3 player; or a portable game device. In that case, the earphone 12 can be plugged into the sound reproducing device that includes the noise cancellation circuitry 10.

Alternatively, the noise cancellation circuitry 10 can be associated with the earphone 12, and the combined system can be plugged into a sound reproducing device, such as a communications device, portable music player, or portable game device as discussed above.

In either case, the noise cancellation circuitry 10 is connected to the earphone 12 by means of a cable 14, which contains one or more wires or pairs of wires.

FIG. 1 shows a single earphone 12, though it will be appreciated that, in many embodiments, a pair of earphones will be provided, each with its own cable connecting it to the noise cancelling system. In that case, the noise cancellation circuitry 10 will be able to handle signals intended for, and received from, each of the earphones.

FIG. 1 shows a feedforward noise cancelling system, in which the earphone 12 is provided with a noise microphone 16, for detecting ambient noise in the vicinity of the earphone, and generating a corresponding electrical signal. The ambient noise signal is passed over the cable 14 to a first input 28 of the noise cancellation circuitry 10 which, in this embodiment, includes a fixed filter 18 and a fixed gain amplifier 20. The output of the amplifier 20 is a noise cancellation signal.

In this embodiment, the noise cancellation circuitry 10 also includes an input 24 for receiving a wanted sound signal, although the invention is equally applicable to noise cancelling systems that simply reduce the ambient noise heard by a wearer with no provision for playing wanted sounds. In this embodiment, the wanted sound can for example be recorded music, or the sound of a telephone call.

The noise cancellation signal generated by the amplifier 20 and the wanted sound signal received on the input 24 are passed to an adder 26, to generate an output signal, which is in turn passed over the cable 14 to a speaker 22.

Thus, the fixed filter 18 and the fixed gain amplifier 20 are designed, based on knowledge of the relevant properties of the system, to generate a noise cancellation signal. The intention is that, when the noise cancellation signal is applied to the speaker 22 in the earphone 12, it generates a sound that is exactly equal in magnitude and opposite in phase to the ambient noise reaching the wearer's ear. When this is achieved, the ambient noise that is heard by the wearer is reduced.

In order to be able to achieve this, it is necessary for the frequency characteristic of the filter 18 to take account of the frequency characteristics of the microphone 16 and of the speaker 22, and to take account of the frequency characteristic of the audio path around the earphone from the ambient to the wearer's ear.

One of the factors that determines the required frequency characteristic of the filter 18 is the frequency response of the speaker 22. The frequency response of the speaker 22 depends on the ability of the speaker 22 to vent air from the rear side of the speaker. It is therefore advantageous for the housing of the earphone 12 to provide a relatively constant degree of sound leakage from the rear of the speaker 22.

Figure 2:
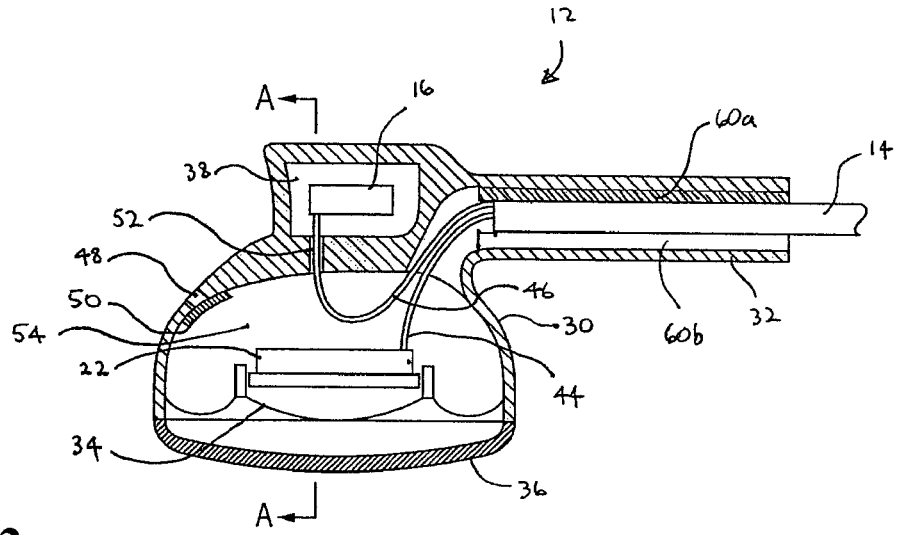
FIG. 2 is a cross-sectional view through an earphone for use in the noise cancellation system of FIG. 1.
Figure 3:
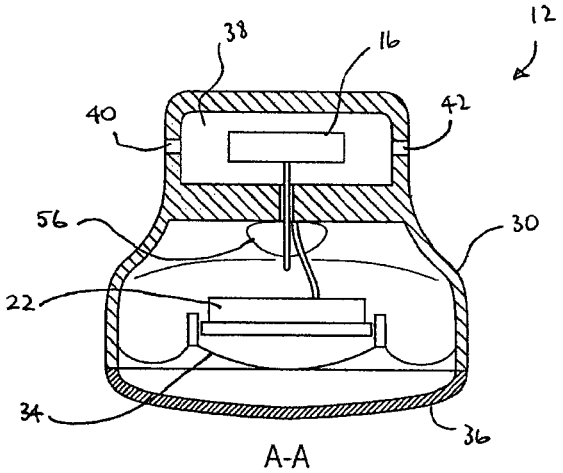
FIG. 3 is a further cross-sectional view through the earphone of FIG. 2.

FIGS. 2 and 3 show an earphone 12 for use in the system of FIG. 1. Specifically, FIG. 2 shows a cross-sectional view through the earphone 12, while FIG. 3 is a cross-sectional view along the line A-A in FIG. 2. The earphone can be made by standard manufacturing techniques, such as plastic moulding or extrusion, or additive manufacturing (3D printing).

The earphone 12 has a housing 30, with an inlet 32 for containing the cable 14. The inlet 32 is in the form of a tube, having a length in the region of 10-20 mm. Mounted in the housing 30 is the speaker 22, having a diaphragm 34. A cover 36, made of a rigid mesh or the like, is provided at the front of the housing to allow the sound generated by the speaker 22 to enter the ear of the wearer when the earphone is being worn, while also protecting the speaker.

The noise microphone 16 is located in a chamber 38, which has holes 40, 42 to allow ambient noise to enter the chamber, where it will be detected by the microphone 16.

A wire 44 leads from the speaker 22 to the noise cancellation unit 10, while a wire 46 leads from the noise microphone 16 to the noise cancellation unit 10. The wires 44, 46 are contained in the cable 14, which passes through the cable inlet 32.

The cable inlet 32 is sized and shaped such that air can pass along it from the rear of the speaker 22 to the outside, thereby providing venting from the rear of the speaker to the outside.

The housing 30 also contains a hole 48, covered on the inside by a dense mesh 50, which provides secondary venting from the rear volume 54 of the speaker to the outside. The secondary venting is used to tune the frequency response of the earphone as desired.

The wire 46 is glued into a hole 52 that leads from the chamber 38 to the rear volume 54 of the speaker 22, which has the effect of providing strain relief on the connection of the wire 46 to the noise microphone 16. Strain relief may be provided on the connection of the wire 44 to the speaker 22, for example by providing a knot in the wire 44.

FIGS. 2 and 3 show an earphone 12 that is suitable for use in a noise cancelling system, as shown in FIG. 1. However, even in an earphone that does not include any noise microphone for use in noise cancellation, it is still possible for the cable inlet to be sized and shaped such that air can pass along it from the rear of the speaker to the outside, thereby providing venting from the rear of the speaker to the outside.

Figure 4A:
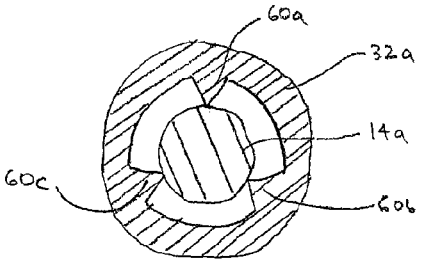
FIGS. 4A, 4B and 4C are cross-sectional views through the cable inlet of the earphone of FIGS. 2 and 3, in different embodiments.
Figure 4B:
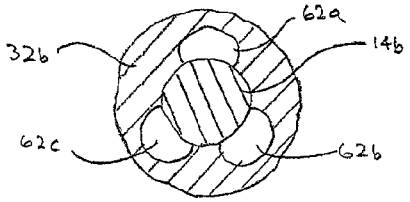
Figure 4C:
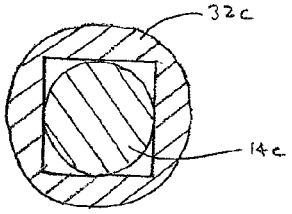

FIGS. 4A, 4B and 4C show the cross-sectional shape of the cable 14 and cable inlet 32, in various embodiments. Specifically, FIG. 4A shows in more detail the embodiment illustrated in FIGS. 2 and 3, in which the cable 14*a* has a circular cross-section, while the inner surface of the cable inlet 32*a* is provided with a number of ribs 60*a*, 60*b*, 60*c*. Thus, the cable is in contact with the inner surface of the cable inlet at three points on their cross-section. This ensures that, even if the cable is able to move within the cable inlet, there still remains a significant area of free space around the cable, meaning that the area through which the rear of the speaker is vented to the outside remains relatively constant. This ensures that the low frequency characteristics of the earphone remains relatively constant, and ensures that the fixed filter 18 and the fixed gain amplifier 20 can be designed with a high degree of confidence that the relevant properties of the system will be unchanged in use.

FIG. 4A shows an embodiment in which the inner surface of the cable inlet is provided with three ribs 60*a*, 60*b*, 60*c*. It will be appreciated that any suitable number of ribs can be provided, such as two, four or six. FIG. 4A also shows an embodiment in which three ribs 60*a*, 60*b*, 60*c* each have a triangular cross-section, but it will be appreciated that they can have any convenient shape.

FIG. 4B shows an embodiment in which the cable 14*b* has a circular cross-section, while the inner surface of the cable inlet 32*b* is provided with a number of trenches 62*a*, 62*b*, 62*c*. Thus, the cable is in contact with the inner surface of the cable inlet over three regions on their cross-section. Again, this ensures that the area through which the rear of the speaker is vented to the outside remains relatively constant, and thus ensures that the low frequency characteristics of the earphone remains relatively constant. As a result, the fixed filter 18 and the fixed gain amplifier 20 can be designed with a high degree of confidence that the relevant properties of the system will be unchanged in use.

FIG. 4B shows an embodiment in which the inner surface of the cable inlet is provided with three trenches 62*a*, 62*b*, 62*c*. It will be appreciated that any suitable number of trenches can be provided, such as two, four or six. FIG. 4B also shows an embodiment in which the trenches 62*a*, 62*b*, 62*c* each have a part-circular cross-section, but it will be appreciated that they can have any convenient shape.

Any ribs or trenches provided on the inner surface of the cable inlet can extend straight along the length of the cable inlet, or can for example be provided in a helical arrangement along the length of the cable inlet.

Any ribs or trenches provided on the inner surface of the cable inlet can extend along the whole length of the cable inlet, or can for example be provided along at least 50%, or along at least 70% or at least 80% of the length of the cable inlet, provided that this is sufficient to ensure that the cross-sectional area, through which the rear of the speaker is vented to the outside, does not become obstructed.

While the illustrated embodiment show the cable having a circular cross-section, and the inner surface of the cable inlet having a non-circular cross-section, it will be apparent that exactly the same effect can be achieved by providing the cable inlet with a circular cross-section and the cable with a non-circular cross-section.

FIG. 4C shows an embodiment in which the inner surface of the cable inlet has a different cross-sectional shape from the cable itself. Specifically, the inner surface of the cable inlet 32*c* has a square cross-section while the cable 14*c* has a circular cross-section, and so the cable is in contact with the inner surface of the cable inlet at four points on their cross-section. Of course, there are many other possibilities. For example, the inner surface of the cable inlet might have a circular cross-section while the cable has a square cross-section, and other cross-sectional shapes can also be used.

In any event, this ensures that the area through which the rear of the speaker is vented to the outside remains relatively constant, and thus ensures that the low frequency characteristics of the earphone remains relatively constant. As a result, the fixed filter 18 and the fixed gain amplifier 20 can be designed with a high degree of confidence that the relevant properties of the system will be unchanged in use.

In all of these illustrated embodiments, the cable is in contact with the inner surface of the cable inlet at at least three points, but this is not necessary to ensure that the area through which the rear of the speaker is vented to the outside remains relatively constant. For example, in an embodiment in which the inner surface of the cable inlet is provided with two trenches, the cable will be in contact with the inner surface of the cable inlet at two regions between the trenches. Provided that the trenches are narrow enough, this will still ensure that the area through which the rear of the speaker is vented to the outside remains relatively constant, although it will of course be necessary to ensure that the trenches are wide enough to provide the required degree of venting.

It was mentioned above that one or more of the wires that form the cable 14 might include a knot for the purposes of strain relief where the wire is connected to the relevant component of the earphone. In such cases, the aperture 56 at which the cable inlet 32 joins the rear volume 54 can be designed such that the aperture 56 cannot be blocked by the knot. For example, when the inner surface of the cable inlet is provided with ribs as shown in FIG. 4A above, the ribs can extend beyond the inner end of the cable inlet, so that the area around the knot cannot be reduced to smaller than the cross sectional area of the leak path along the conduit.

Figure 5:
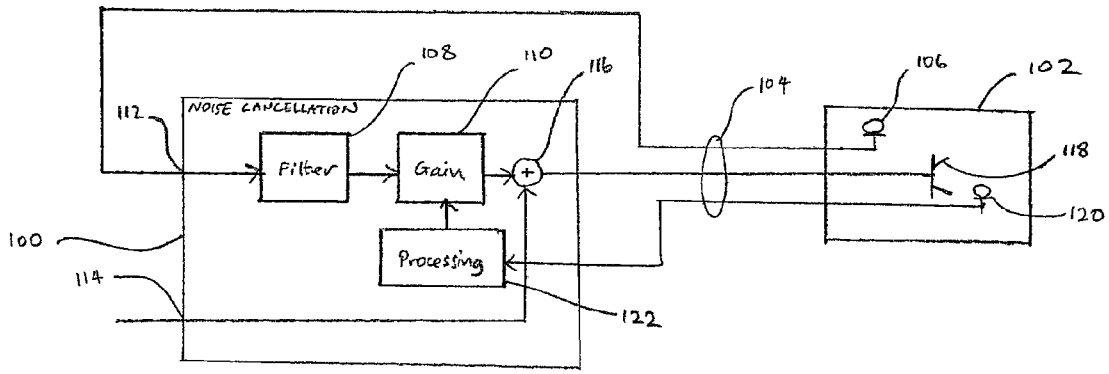
FIG. 5 illustrates a second noise cancellation system.

FIG. 5 shows the form of a second noise cancelling system, including noise cancellation circuitry 100, for use with an earphone 102. The noise cancellation circuitry 100 can for example be provided in a sound reproducing device, such as a communications device, for example a mobile phone; a portable music player, for example an MP3 player; or a portable game device. In that case, the earphone 102 can be plugged into the sound reproducing device that includes the noise cancellation circuitry 100.

Alternatively, the noise cancellation circuitry 100 can be associated with the earphone 102, and the combined system can be plugged into a sound reproducing device, such as a communications device, portable music player, or portable game device as discussed above.

In either case, the noise cancellation circuitry 100 is connected to the earphone 102 by means of a cable 104, which contains one or more wires or pairs of wires.

FIG. 5 shows a single earphone 102, though it will be appreciated that, in many embodiments, a pair of earphones will be provided, each with its own cable connecting it to the noise cancellation circuitry 100. In that case, the noise cancellation circuitry 100 will be able to handle signals intended for, and received from, each of the earphones.

FIG. 5 shows an adaptive feedforward noise cancelling system, in which the earphone 102 is provided with a noise microphone 106, for detecting ambient noise in the vicinity of the earphone, and generating a corresponding electrical signal. The ambient noise signal is passed to a first input 112 of the noise cancellation circuitry 100 which, in this embodiment, includes a fixed filter 108 and an amplifier 110 with a controllable gain. The output of the amplifier 110 is a noise cancellation signal.

In this embodiment, the noise cancellation circuitry 100 also includes an input 114 for receiving a wanted sound signal, although the invention is equally applicable to noise cancelling systems that simply reduce the ambient noise heard by a wearer with no provision for playing wanted sounds. In this embodiment, the wanted sound can for example be recorded music, or the sound of a telephone call.

The noise cancellation signal generated by the amplifier 110 and the wanted sound signal received on the input 114 are passed to an adder 116, to generate an output signal, which is in turn passed to a speaker 118.

An error microphone 120 is provided in the earphone 102, positioned so that it is able to detect the sounds at the entrance to the wearer's ear canal. The signal generated by the error microphone 120 therefore acts as a measure of the sound leakage between the earphone 102 and the wearer's ear.

The filter 108 and the range of gain values that can be produced by the amplifier 110 are designed, based on knowledge of the relevant properties of the system, to generate a noise cancellation signal. The intention is that, when the noise cancellation signal is applied to the speaker 118 in the earphone 102, it generates a sound that is exactly equal in magnitude and opposite in phase to the ambient noise reaching the wearer's ear. When this is achieved, the ambient noise that is heard by the wearer is reduced.

As discussed above, this is achieved when the frequency characteristic of the filter 108 matches the frequency characteristics of the microphone 106 and of the speaker 118, and matches the frequency characteristic of the audio path around the earphone from the ambient to the wearer's ear.

One of the factors that determines the required frequency characteristic of the filter 108 is the frequency response of the speaker 118. The frequency response of the speaker 118 depends on the ability of the speaker to vent air from the rear side of the speaker. It is therefore advantageous for the housing of the earphone 102 to provide a relatively constant degree of sound leakage from the rear of the speaker 118.

In addition, noise reduction is improved when the gain value applied by the amplifier 110 ensures that the amplitude of the sound that is generated by the speaker 118 in response to the noise cancellation signal matches the amplitude of the ambient noise reaching the wearer's ear. This amplitude is determined to some degree by the way in which the earphone 102 is located in the wearer's ear. When the earphone is worn loosely in the wearer's ear, the amount of ambient noise reaching the ear canal is relatively high, and so a relatively high level noise cancellation signal produces the best noise reduction effect. By contrast, when the earphone is worn pressed against the wearer's ear, the amount of ambient noise reaching the ear canal is relatively low, and so a relatively low level noise cancellation signal is required to produce the best noise reduction effect.

As mentioned above, the signal generated by the error microphone acts as a measure of this sound leakage between the earphone 102 and the wearer's ear. The signal is therefore passed to a processing unit 122 in the noise cancellation unit 100. Based on the signal received from the error microphone 120, the processing unit 122 controls the gain that is applied by the amplifier 110, so that the amplitude of the sound produced by the speaker 118 in response to the noise cancellation signal is substantially equal to the amplitude of the ambient noise reaching the wearer's ear.

In some situations, the way in which the earphone 102 is worn will also affect the frequency characteristic of the audio path around the earphone from the ambient to the wearer's ear. In that case, the processing unit 122 can also adapt the frequency response of the filter 108, based on the signal received from the error microphone 120, in order to compensate for this.

Figure 6:
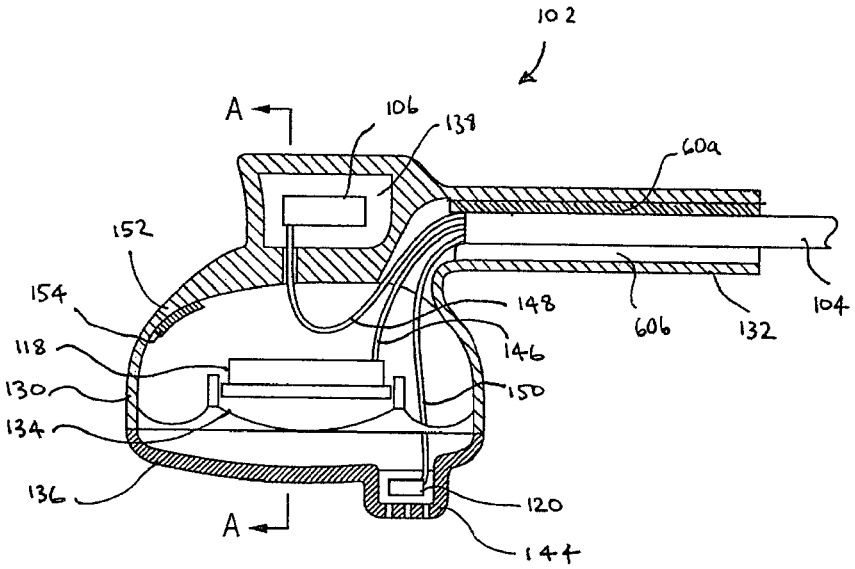
FIG. 6 is a cross-sectional view through an earphone for use in the noise cancellation system of FIG. 5.
Figure 7:
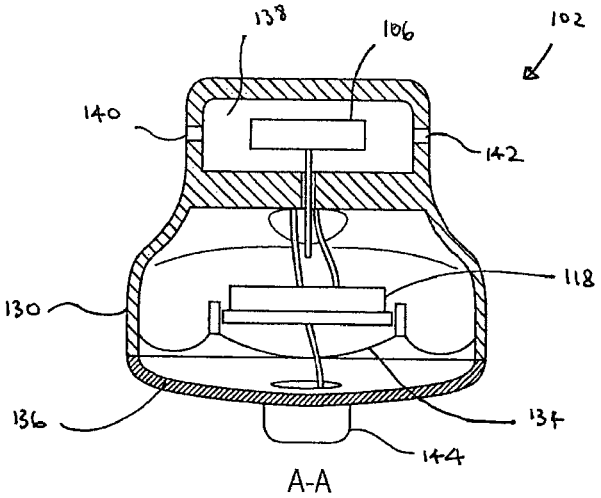
FIG. 7 is a further cross-sectional view through the earphone of FIG. 6.

FIGS. 6 and 7 illustrate a form of the earphone 102, for use in the system of FIG. 5. Specifically, FIG. 6 shows a cross-sectional view through the earphone 102, while FIG. 7 is cross-sectional view along the line A-A in FIG. 6.

The earphone 102 has a housing 130, with an inlet 132 for containing the cable 104. The inlet 132 is in the form of a tube, having a length in the region of 10-20 mm. Mounted in the housing 130 is the speaker 118, having a diaphragm 134. A cover 136, made of a rigid mesh or the like, is provided at the front of the housing to allow the sound generated by the speaker 118 to enter the ear of the wearer when the earphone is being worn, while also protecting the speaker.

The noise microphone 106 is located in a chamber 138, which has holes 140, 142 to allow ambient noise to enter the chamber, where it will be detected by the microphone 106.

The error microphone 120 is located in a projection 144, which extends from the front surface of the earphone, so that it will be located in the entrance to the wearer's ear canal in use. As an alternative, the error microphone can be located inside the housing 130, with the projection 144 having a sound inlet that is connected to the error microphone through an acoustic channel, such that the error microphone is still able to detect sound in the entrance to the wearer's ear canal in use.

A wire 146 leads from the speaker 118 to the noise cancellation unit 10, while a wire 148 leads from the noise microphone 106 to the noise cancellation unit 10, and a wire 150 leads from the error microphone 120 to the noise cancellation unit 10. The wires 146, 148, 150 are contained in the cable 104, which passes through the cable inlet 132.

The housing 130 also contains a hole 152, covered on the inside by a dense mesh 154, which provides secondary venting from the rear of the speaker to the outside. The secondary venting is used to tune the frequency response of the earphone as desired.

The cable inlet 132 is sized and shaped such that air can pass along it from the rear of the speaker 118 to the outside, thereby providing venting from the rear of the speaker to the outside. More specifically, the cable inlet 132 is sized and shaped such that, regardless of any movement of the cable 104, it still provides a relatively constant cross-sectional area along which air can pass, thereby providing a predictable level of venting from the rear of the speaker to the outside. In addition, providing the venting through the cable inlet has the advantage that the venting is unlikely to become coupled by accident to the noise microphone.

As shown in FIG. 6, the cable inlet 132 is provided with three ribs 60*a*, 60*b*, 60*c* (the latter not shown in FIG. 6), ensuring that there is a gap between the cable 104 and the inner surface of the cable inlet 132. More generally, the cable inlet 132 can for example have one of the forms shown in FIGS. 4A, 4B and 4C.

Figure 8:
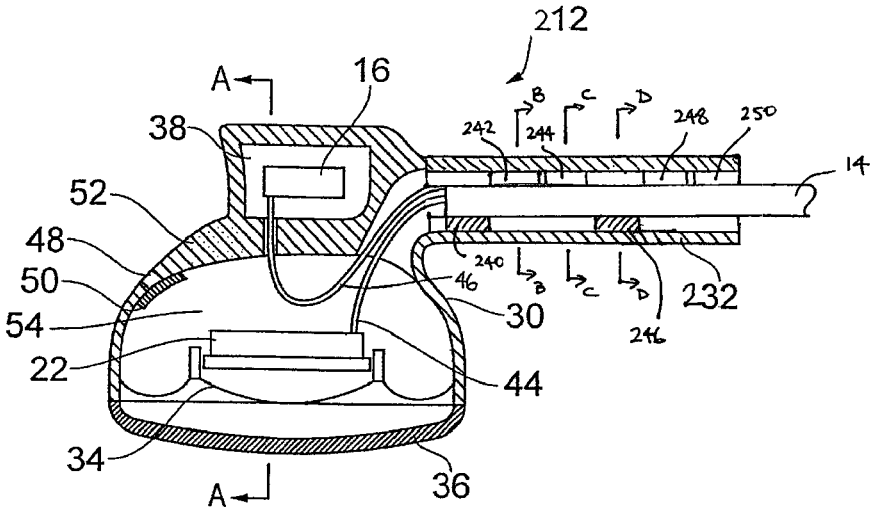
FIG. 8 is a cross-sectional view through an alternative earphone for use in the noise cancellation system of FIG. 1.

FIG. 8 shows an alternative earphone 212 for use in the system of FIG. 1. Specifically, FIG. 8 shows a cross-sectional view through the earphone 212. The earphone 212 is generally similar to the earphone 12 shown in FIG. 2, and will be described here only so far as is necessary to explain the differences between the earphone 212 and the earphone 12. The cross-sectional view along the line A-A in FIG. 8 is as shown in FIG. 3. Thus, the earphone 212 can be made by standard manufacturing techniques, such as plastic moulding or extrusion, or additive manufacturing (3D printing).

The earphone 212 has a housing 30, with an inlet 232 for containing the cable 14. The inlet 232 is in the form of a tube, having a length in the region of 10-20 mm. Mounted in the housing 30 is the speaker 22, having a diaphragm 34. A cover 36, made of a rigid mesh or the like, is provided at the front of the housing to allow the sound generated by the speaker 22 to enter the ear of the wearer when the earphone is being worn, while also protecting the speaker.

The noise microphone 16 is located in a chamber 38, which has holes 40, 42 to allow ambient noise to enter the chamber, where it will be detected by the microphone 16.

A wire 44 leads from the speaker 22 to the noise cancellation unit 10, while a wire 46 leads from the noise microphone 16 to the noise cancellation unit 10. The wires 44, 46 are contained in the cable 14, which passes through the cable inlet 232.

The cable inlet 232 is sized and shaped such that air can pass along it from the rear of the speaker 22 to the outside, thereby providing venting from the rear of the speaker to the outside.

The housing 30 also contains a hole 48, covered on the inside by a dense mesh 50, which provides secondary venting from the rear volume 54 of the speaker to the outside. The secondary venting is used to tune the frequency response of the earphone as desired.

The wire 46 is glued into a hole 52 that leads from the chamber 38 to the rear volume 54 of the speaker 22, which has the effect of providing strain relief on the connection of the wire 46 to the noise microphone 16. Strain relief may be provided on the connection of the wire 44 to the speaker 22, for example by providing a knot in the wire 44.

FIG. 8 shows an earphone 212 that is suitable for use in a noise cancelling system, as shown in FIG. 1. However, even in an earphone that does not include any noise microphone for use in noise cancellation, it is still possible for the cable inlet to be sized and shaped such that air can pass along it from the rear of the speaker to the outside, thereby providing venting from the rear of the speaker to the outside.

Figure 9A:
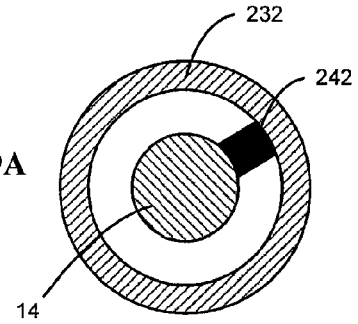
FIGS. 9A, 9B and 9C are cross-sectional views through the cable inlet of the earphone of FIG. 8, at different positions.
Figure 9B:
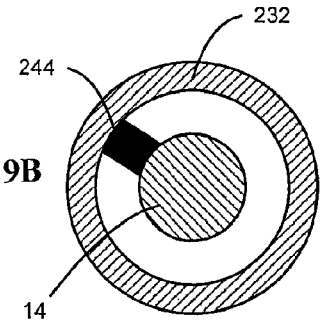
Figure 9C:
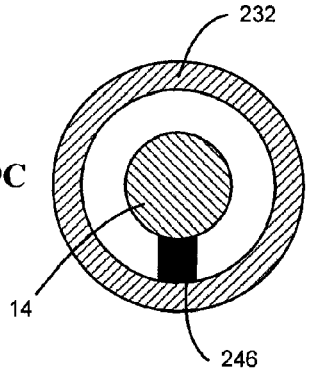

FIGS. 9A, 9B and 9C show cross-sectional views through the cable 14 and cable inlet 232. Specifically, FIG. 9A shows the cross-sectional view along the line B-B, FIG. 9B shows the cross-sectional view along the line C-C, and FIG. 9C shows the cross-sectional view along the line D-D.

Thus, the inner surface of the cable inlet 232 is provided with multiple projections 240, 242, 244, 246, 248, 250, which together act to keep the cable 14 in its intended position, while allowing air to pass along the cable inlet to provide venting from the rear of the speaker to the outside.

In this illustrated embodiment, each of the projections 240, 242, 244, 246, 248, 250 is approximately 1.5-3 mm long (that is, in the longitudinal direction of the cable inlet), and there is a very small gap between the longitudinal positions of the projections 240, 242, 244, 246, 248, 250. However, they could be positioned so that there is no gap.

Although FIG. 8 shows six projections, there could be any number of such projections along the length of the cable inlet 232, with the length of each projection (that is, the dimension in the longitudinal direction of the cable inlet) being set so that the projections extend over most or all of the length of the cable inlet.

As shown in FIGS. 9A, 9B and 9C, the projections 240, 242, 244, 246, 248, 250 are at positions that are spaced apart by 120° in the circumferential direction on the inner surface of the cable inlet 232. Thus, the projections 240, 246 are at a first circumferential position as shown in FIG. 9C, the projections 242, 248 are at a second circumferential position that is spaced by 120° from the first circumferential position as shown in FIG. 9A, and the projections 244, 250 are at a third circumferential position that is spaced by 120° from both the first and second circumferential positions as shown in FIG. 9B.

As shown in FIGS. 9A, 9B and 9C, the projections 240, 242, 244, 246, 248, 250 each have a rectangular cross-section. However, other cross-sectional shapes are possible. For example, a triangular cross-section as shown in FIG. 4A is possible.

Figure 10A:
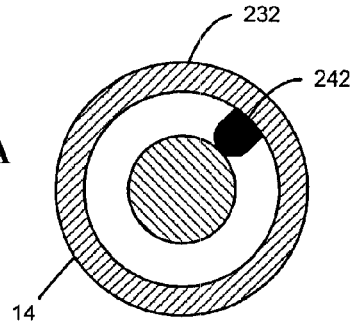
FIGS. 10A, 10B and 10C are cross-sectional views through the cable inlet of the earphone of FIG. 8, at different positions, in an alternative embodiment.
Figure 10B:
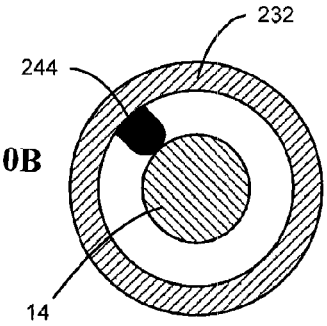
Figure 10C:
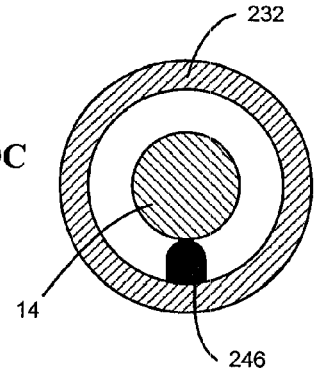

As another example, FIGS. 10A, 10B and 10C show an arrangement similar to FIGS. 9A, 9B and 9C, with FIG. 10A showing the cross-sectional view along the line B-B, FIG. 10B showing the cross-sectional view along the line C-C, and FIG. 10C showing the cross-sectional view along the line D-D, in which the projections 240, 242, 244, 246, 248, 250 each have a rectangular cross-section with a domed end. In a further example, the projections may be entirely domed, for example with a part-spherical shape.

In these examples, the projections are in three lines along the inner surface of the cable inlet 232, at positions that are spaced apart by 120° in the circumferential direction. However, the same effect could be achieved by providing projections in two lines, or in four or more lines, up to a likely maximum of about eight lines.

Figures 11A, 11B, 11C, 11D:
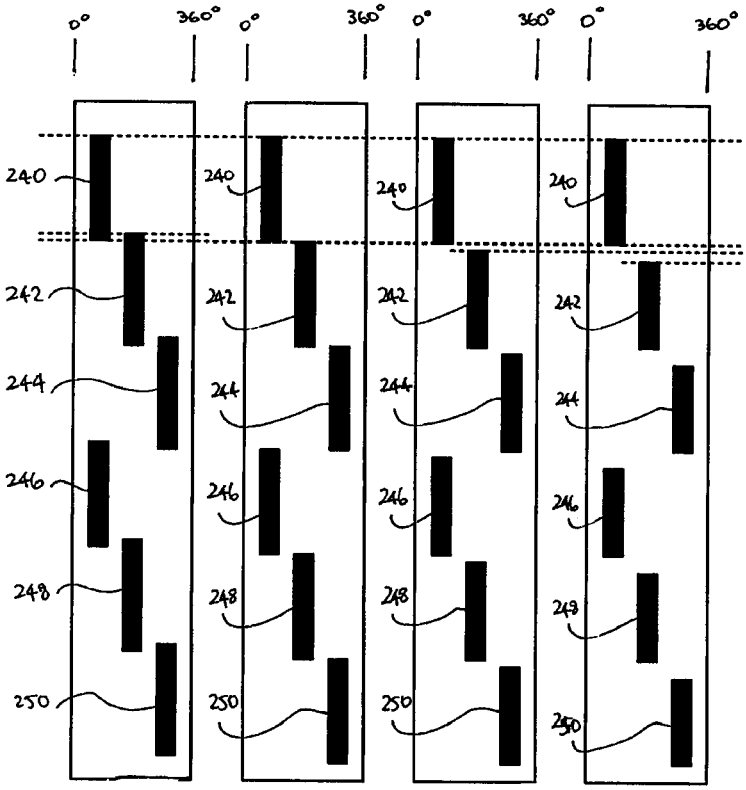
FIGS. 11A, 11B, 11C and 11D are a further illustration of the cable inlet of the earphone of FIG. 8.
Figure 12:
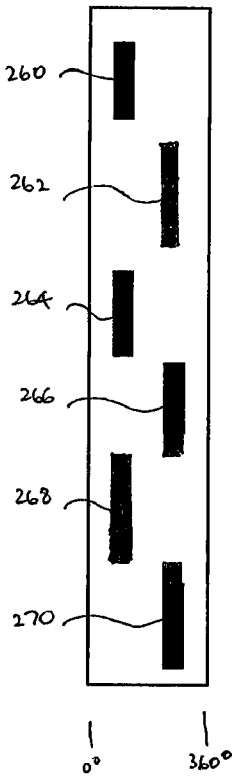
FIG. 12 is an illustration similar to FIG. 11 of an alternative form of the cable inlet.

FIGS. 11 and 12 are views to show the positions of the projections on the inner surface of the cable inlet. Thus, in FIGS. 11 and 12, the horizontal position represents the circumferential positions of the projections around the inner surface of the cable inlet, while the vertical position represents the longitudinal positions of the projections along the inner surface of the cable inlet.

Thus, in FIGS. 11A, 11B, 11C and 11D, the projections 240 and 246 are along one line, the projections 242 and 248 are along another line at a circumferential spacing of 120°, and the projections 244 and 250 are along another line at a further circumferential spacing of 120°.

In FIG. 11A, there is a very slight overlap between the longitudinal positions of successive projections, such as the projections 240, 242 etc. In FIG. 11B there is no overlap between the longitudinal positions of successive projections, such as the projections 240, 242 etc. In FIG. 11C there is a small gap between the longitudinal positions of successive projections, such as the projections 240, 242 etc. In FIG. 11D there is a slightly larger gap between the longitudinal positions of successive projections, such as the projections 240, 242 etc.

In FIG. 12, there are three projections 260, 264, 268 along one line, and three projections 262, 266, 270 along another line at a circumferential spacing of 180° therefrom.

Thus, in these embodiments, the cable 14 is in contact with the inner surface of the cable inlet 232 at substantially every position along the cable inlet, with the result that movement of the cable 14 within the cable inlet 232 is substantially prevented, but there still remains a significant area of free space around the cable, meaning that the area through which the rear of the speaker is vented to the outside remains relatively constant, and sufficient to ensure good venting. This ensures that the low frequency characteristics of the earphone remains relatively constant, and ensures that the fixed filter 18 and the fixed gain amplifier 20 can be designed with a high degree of confidence that the relevant properties of the system will be unchanged in use.

Although FIGS. 8-10 show embodiments in which the cable 14 is in contact with the inner surface of the cable inlet 232 at one point at substantially every position along the cable inlet, projections could be provided so the cable 14 is in contact with the inner surface of the cable inlet 232 at two points along substantially the whole length of position along the cable inlet.

There are described above earphones in which the cable inlet 232 has projections on the inner surface thereof, with each projection extending along only a part of the length of the cable inlet. This has been described with reference to an earphone that is generally as shown in FIGS. 2 and 3. An earphone that is generally as shown in FIGS. 6 and 7 can also be provided with a cable inlet having projections as shown in, and described with reference to, FIGS. 8-10.

There is thus disclosed an earphone that can be used, for example with a noise cancellation system, to provide good audio performance.

What is claimed is:

1. An earphone, comprising:

an earphone housing; and a speaker mounted within the earphone housing;

wherein the earphone comprises a cable inlet, comprising a cable that includes a wire connected to the speaker; and wherein the cable inlet has projections on an inner surface thereof, such that only a part of a cross-section of the cable is in contact with said projections on the inner surface of the cable inlet over a substantial portion of the length of the cable inlet, while a rear volume of the speaker is vented through the cable inlet.

2. An earphone as claimed in claim 1, wherein the projections have rectangular cross-sections.

3. An earphone as claimed in claim 1, wherein the projections have domed shapes.

4. An earphone as claimed in claim 1, wherein the projections have triangular cross-sections.

5. An earphone as claimed in claim 1, wherein the projections are provided in multiple lines extending along a length of the cable inlet.

6. An earphone as claimed in claim 5, wherein there are from 2-8 lines of projections.

7. An earphone as claimed in claim 1, wherein there is a maximum of 1 or 2 projections at each longitudinal position along the length of the cable inlet.

8. An earphone as claimed in claim 7, wherein there is a maximum of 1 projection at each longitudinal position along the length of the cable inlet.

9. An earphone as claimed in claim 7, wherein there are gaps between the longitudinal positions of the projections.

10. An earphone as claimed in claim 1, further comprising:

a first microphone, positioned to detect ambient noise approaching the ear of a wearer of the earphone, wherein the cable further includes a wire connected to the first microphone.

11. An earphone as claimed in claim 10, wherein the first microphone is located in a chamber within the housing, said chamber being isolated from the rear volume of the speaker and having at least one hole to the exterior of the earphone.

12. An earphone as claimed in claim 1, further comprising:

a second microphone, positioned to detect noise entering the ear of a wearer of the earphone, wherein the cable further includes a wire connected to the second microphone.

13. An earphone as claimed in claim 1, wherein the second microphone is positioned in front of the speaker.

14. An earphone as claimed in claim 1, having a hole in the housing, such that the rear volume of the speaker is additionally vented through the hole.

15. An earphone as claimed in claim 1, wherein the cable and the cable inlet have cross-sectional shapes and sizes such that the cable is in contact with the inner surface of the cable inlet at at least three points on its cross-section.

16. A noise cancelling system, comprising:

noise cancellation circuitry; and an earphone, the earphone comprising:

an earphone housing;

a speaker mounted within the earphone housing;

a first microphone, positioned to detect ambient noise approaching the ear of a wearer of the earphone; and a cable inlet, comprising a cable that includes a wire connected to the speaker and a wire connected to the first microphone;

wherein the cable inlet has projections on an inner surface thereof, such that only a part of a cross-section of the cable is in contact with said projections on the inner surface of the cable inlet over a substantial portion of the length of the cable inlet, while a rear volume of the speaker is vented through the cable inlet; and wherein the noise cancellation circuitry is adapted to receive an ambient noise signal from the first microphone, and to generate a noise cancellation signal in response thereto.

17. A noise cancelling system, comprising:

noise cancellation circuitry; and an earphone, the earphone comprising:

an earphone housing;

a speaker mounted within the earphone housing;

a first microphone, positioned to detect ambient noise approaching the ear of a wearer of the earphone;

a second microphone, positioned to detect noise entering the ear of a wearer of the earphone; and a cable inlet, comprising a cable that includes a wire connected to the speaker, a wire connected to the first microphone, and a wire connected to the second microphone;

wherein the cable inlet has projections on an inner surface thereof, such that only a part of a cross-section of the cable is in contact with said projections on the inner surface of the cable inlet over a substantial portion of the length of the cable inlet, while a rear volume of the speaker is vented through the cable inlet; and wherein the noise cancellation circuitry is adapted to receive an ambient noise signal from the first microphone, and to generate a noise cancellation signal in response thereto, and wherein the noise cancellation circuitry is adapted to receive an error signal from the second microphone, and to control an amount of gain applied to the ambient noise signal to generate the noise cancellation signal in response to the error signal.

18. An earphone, comprising:

an earphone housing; and a speaker mounted within the earphone housing;

wherein the earphone comprises a cable inlet comprising a cable that includes a wire connected to the speaker; and wherein the cable and the cable inlet have different cross-sectional shapes, such that only a part of a cross-section of the cable is in contact with the inner surface of the cable inlet at at least two points on their cross-section over a substantial portion of their length, while a rear volume of the speaker is vented through the cable inlet.

19. An earphone as claimed in claim 18, further comprising:

a first microphone, positioned to detect ambient noise approaching the ear of a wearer of the earphone, wherein the cable further includes a wire connected to the first microphone.

20. An earphone as claimed in claim 19, wherein the first microphone is located in a chamber within the housing, said chamber being isolated from the rear volume of the speaker and having at least one hole to the exterior of the earphone.

21. An earphone as claimed in claim 18, further comprising:

a second microphone, positioned to detect noise entering the ear of a wearer of the earphone, wherein the cable further includes a wire connected to the second microphone.

22. An earphone as claimed in claim 21, wherein the second microphone is positioned in front of the speaker.

23. An earphone as claimed in claim 18, having a hole in the housing, such that the rear volume of the speaker is additionally vented through the hole.

24. An earphone as claimed in claim 18, wherein the cable has a circular cross-section and the cable inlet has a generally circular internal cross-section, with a plurality of ribs protruding from an inner surface thereof, along at least a part of said inner surface.

25. An earphone as claimed in claim 24, wherein said plurality of ribs protrude from the inner surface thereof along at least 50% of the length of said inner surface.

26. An earphone as claimed in claim 25, wherein said plurality of ribs extend beyond an inner end of the cable inlet, into the rear volume of the speaker.

27. An earphone as claimed in claim 18, wherein the cable inlet is in the form of a tube, having a length of at least 10 mm.

* * * * *